US011035185B2

(12) United States Patent
Halderman et al.

(10) Patent No.: US 11,035,185 B2
(45) Date of Patent: Jun. 15, 2021

(54) ANNULAR PRESSURE REDUCTION SYSTEM FOR HORIZONTAL DIRECTIONAL DRILLING

(71) Applicant: Quanta Associates, L.P., Houston, TX (US)

(72) Inventors: Ronald G. Halderman, Billings, MT (US); Pablo Esteban Guerra, Houston, TX (US); Karl D. Quackenbush, Blanchard, MI (US)

(73) Assignee: Quanta Associates, L.P., Houston, TX (US)

( * ) Notice: Subject to any disclaimer, the term of this patent is extended or adjusted under 35 U.S.C. 154(b) by 136 days.

(21) Appl. No.: 16/198,451

(22) Filed: Nov. 21, 2018

(65) Prior Publication Data

US 2019/0153783 A1 May 23, 2019

Related U.S. Application Data

(60) Provisional application No. 62/589,853, filed on Nov. 22, 2017.

(51) Int. Cl.
*E21B 21/08* (2006.01)
*E21B 7/04* (2006.01)
*E21B 21/01* (2006.01)

(52) U.S. Cl.
CPC ..... *E21B 21/08* (2013.01); *E21B 7/046* (2013.01); *E21B 21/01* (2013.01)

(58) Field of Classification Search
CPC ..... E21B 7/046; E21B 21/08; E21B 33/085
See application file for complete search history.

(56) References Cited

U.S. PATENT DOCUMENTS

| | | | | |
|---|---|---|---|---|
| 4,003,440 | A * | 1/1977 | Cherrington | E21B 7/046 175/61 |
| 4,117,895 | A * | 10/1978 | Ward | E21B 4/02 175/107 |
| 4,221,503 | A | 9/1980 | Cherrington | |
| 5,158,140 | A | 10/1992 | Ferry | |
| 5,176,211 | A * | 1/1993 | Halderman | E21B 7/28 175/206 |
| 5,269,384 | A * | 12/1993 | Cherrington | E21B 7/28 175/102 |
| 5,375,669 | A * | 12/1994 | Cherrington | E21B 7/28 175/102 |
| 7,204,327 | B2 | 4/2007 | Livingstone | |
| 8,794,352 | B2 | 8/2014 | Halderman et al. | |
| 10,047,562 | B1 * | 8/2018 | Cherrington | E21B 21/00 |
| 2004/0104052 | A1 | 6/2004 | Livingstone | |

(Continued)

OTHER PUBLICATIONS

Young, Lee W., International Search Report for PCT/US2018/062309, dated Feb. 6, 2019, 2 pages, ISA/US, Alexandria, Virginia.

(Continued)

*Primary Examiner* — Robert E Fuller
(74) *Attorney, Agent, or Firm* — Oathout Law Firm; Mark A. Oathout

(57) ABSTRACT

Working an underground arcuate path around at least a portion of an obstacle with a casing extending into the underground arcuate path, connecting a rotating control device to the casing; and a Venturi device connected to the rotating control device.

1 Claim, 3 Drawing Sheets

(56) References Cited

U.S. PATENT DOCUMENTS

| | | | |
|---|---|---|---|
| 2008/0060846 | A1 | 3/2008 | Belcher et al. |
| 2013/0341033 | A1 | 12/2013 | Carstensen et al. |
| 2014/0069720 | A1 | 3/2014 | Gray |

OTHER PUBLICATIONS

Young, Lee W., Written Opinion of the International Searching Authority for PCT/US2018/062309, dated Feb. 6, 2019, 6 pages, ISA/US, Alexandria, Virginia.

Washington Rotating Control Heads, Inc., "Series 1300 Rotating Control Heads 11" thru 16"", at least as early as Oct. 18, 2017, 1 page, Washington, PA.

* cited by examiner

ANNULAR PRESSURE REDUCTION SYSTEM FOR HORIZONTAL DIRECTIONAL DRILLING

TECHNICAL FIELD

Horizontal Directional Drilling (referred to as "HDD" below) is a sophisticated technique used to install utilities, such as natural gas pipe lines, electric and many other infrastructural needs under ground level. This technique is steadily becoming more popular in the underground construction industry, in most cases the HDD method has proven over time to be the most cost effective solution in allowing normal every day operations to continue in the construction area surroundings.

BACKGROUND

Drilling mud is a primary ingredient needed in performing HDD crossings, compiled of manufactured clays mined from the earth. Mud properties are responsible for many stages of a successful HDD project. These responsibilities range from steering the down hole tooling, to cooling the tooling, even powering down hole equipment. A vital characteristic of mud used during the drilling process is its ability to carry spoils to surface making clearance for the drilling equipment advancing forward with pipe and tooling underground to varying depths and distances.

Mud operation in a HDD project can be considered a closed circuit configuration. Mud is pumped down hole through the drill string where it exits through various orifices in the down hole drill tooling. It then returns to surface carrying soils and/or cuttings. Once on surface the cuttings saturated mud is pumped to a recycling system where the cuttings are separated from the drilling mud and the clean mud is sent back to the mud pump for reuse.

Horizontal drilling productivity and efficiency is directly related to maintaining constant and continuous drilling fluid or mud "returns" along the bored path back to the entry point at the surface. An event commonly referred to as a "frac-out", also known as an inadvertent return, occurs when excessive drilling pressure results in drilling mud escaping from the borehole and propagating toward the surface (e.g. the ground fractures and fluid escapes or propagates toward the surface). A frac-out can be costly due to work stoppage for cleanup, can cause safety concerns, and can severely affect environmentally sensitive areas.

A need therefore exists for apparatuses and methods for eliminating or substantially reducing these all too frequent frac-outs or inadvertent returns.

SUMMARY

Working an underground arcuate path around at least a portion of an obstacle with a casing extending into the underground arcuate path, connecting a rotating control device to the casing; and a Venturi device connected to the rotating control device.

As used herein the phrase "rotating control device" is inclusive of rotating blowout preventers or RBOPs, rotating control heads, and other devices to enclose or close an underground arcuate path, to seal to drill pipe (the drill pipe to be optionally turned and axially moved), and to control annular pressure within the space encircling the drill pipe.

BRIEF DESCRIPTION OF THE FIGURES OF THE DRAWINGS

The exemplary embodiments may be better understood, and numerous objects, features, and advantages made apparent to those skilled in the art by referencing the accompanying drawings. These drawings are used to illustrate only exemplary embodiments, and are not to be considered limiting of its scope, for the disclosure may admit to other equally effective exemplary embodiments. The figures are not necessarily to scale and certain features and certain views of the figures may be shown exaggerated in scale or in schematic in the interest of clarity and conciseness.

DETAILED DESCRIPTION OF PREFERRED EMBODIMENT(S)

The description that follows includes exemplary apparatus, methods, techniques, and instruction sequences that embody techniques of the inventive subject matter. However, it is understood that the described embodiments may be practiced without these specific details.

Figure 1:
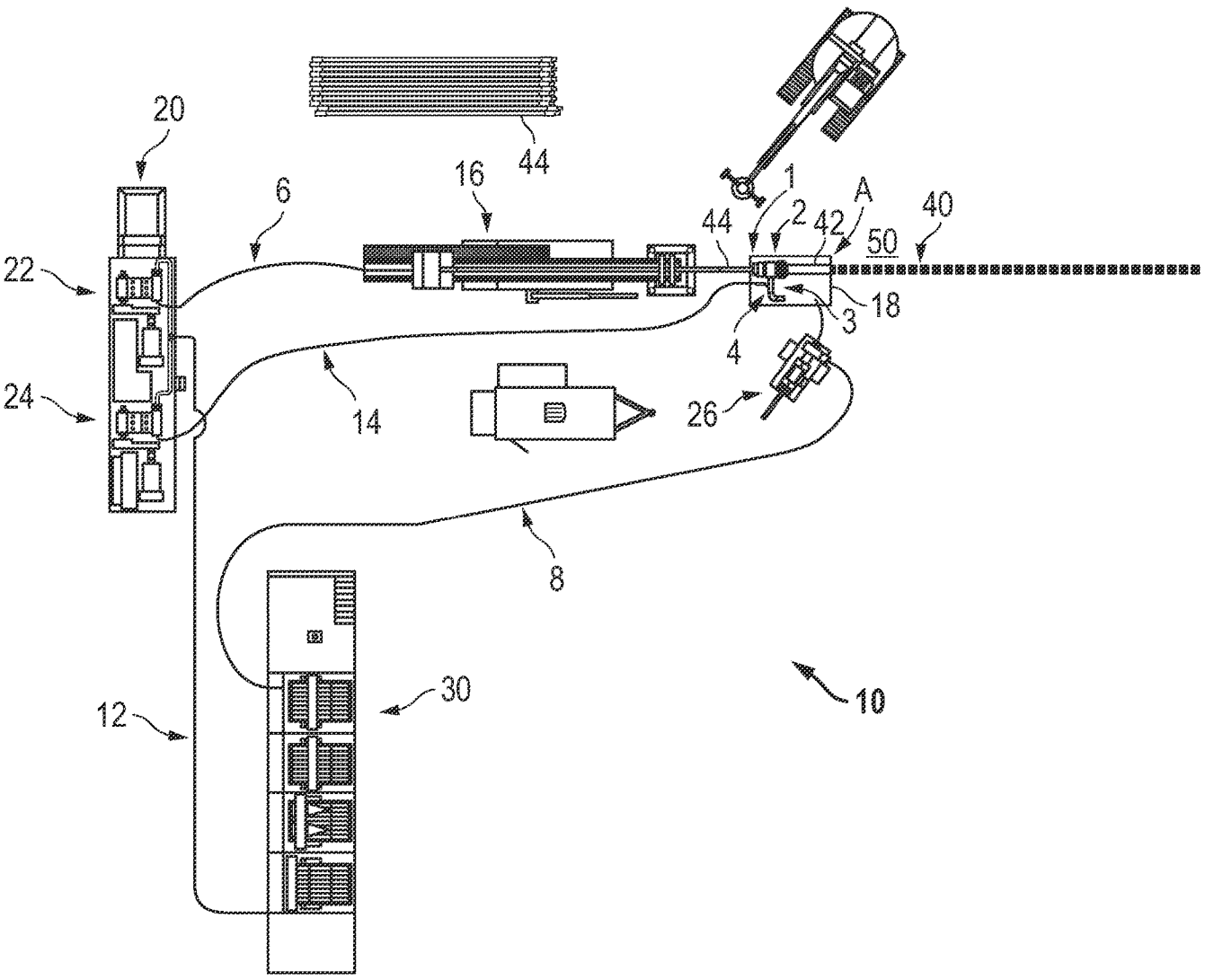
FIG. 1 depicts a top view of an exemplary embodiment of a mud recovery system using a rotating blowout preventer and Venturi device.

With reference to FIG. 1, an exemplary embodiment of a mud recovery system or apparatus 10 using a rotating control device 1, such as a blowout preventer ("RBOP") 2, and venturi device 3 is depicted. An aspirator/ejector 4 may be connected to the venturi device 3. A horizontal drilling rig or drill rig 16 loads and advances drill pipe 44 by turning and pushing into ground or rock formation or earth 50 at a planned degree of angle through a casing 42 at entry or entrance A. The casing 42 adjoins the ground, rock formation or earth 50. An RBOP 2 is used to close, seal or cap the casing, while still allowing rotation of the drill pipe. A mud pump or drill pump 22 sends drill mud at a calculated pressure and flow through the mud line 6 towards the drill rig 16. Mud then travels through the interior of the drill pipe 44 exiting the down hole tooling such as a drill bit 48 (not shown in FIG. 1).

When mud has exited the down hole tooling (not shown in FIG. 1) at high velocity and drill pipe 44 continues to advance, the surrounding formation 50 is broken down suspending itself in the drilling mud. The flow continues to travel to the area between the exterior of the drill pipe 44 and the interior of the bore 56 (shown in FIG. 3) upward to surface carrying the soils and/or cuttings within the drill mud. The Venturi device 3 is connected to the rotating control device 1, and a venturi mud line pump 24 pumps through the venturi mud line or venturi flow line 14.

Frac-outs or inadvertent returns occur when the annular pressure limits is/are exceeded (relative to the surroundings). When the annular pressure is exceeded, the muds or fluids will follow a less resistant, unintended path often to surface or along a natural path to some other unintended location. In order to reduce the annular pressure, and thus eliminate or mitigate the chances of a frac-out, the mud recovery system 10 uses an RBOP 2 and a Venturi device 3 to take advantage of Bernoulli's principle in pulling, lifting, or sucking or pumping out the muds traveling upward to the surface through the area between the exterior of the drill pipe 44 and the interior of the bore hole 56 (shown in FIG. 3) at entry A (also shown in FIG. 3).

The trash pump or dirty mud line pump 26 pumps dirty mud from the pit 18 through the dirty mud line 8 to the mud cleaning unit 30. The mud cleaning unit 30 may be a continuous cleaning system which may utilize a plurality of screens or filters and may include a plurality of centrifuges which clean or separate soils and/or cuttings from the mud. The cleaned mud leaves the mud cleaning unit 30 through the clean mud line 12 to the pumping unit 20. The mud pump 22 pumps the muds through the mud line 6 downhole. The pumping unit 20 may include the mud pump 22 and the venturi mud line pump 24, or the mud pump 22 and the venturi mud line pump 24 may be separate units.

Figure 2:
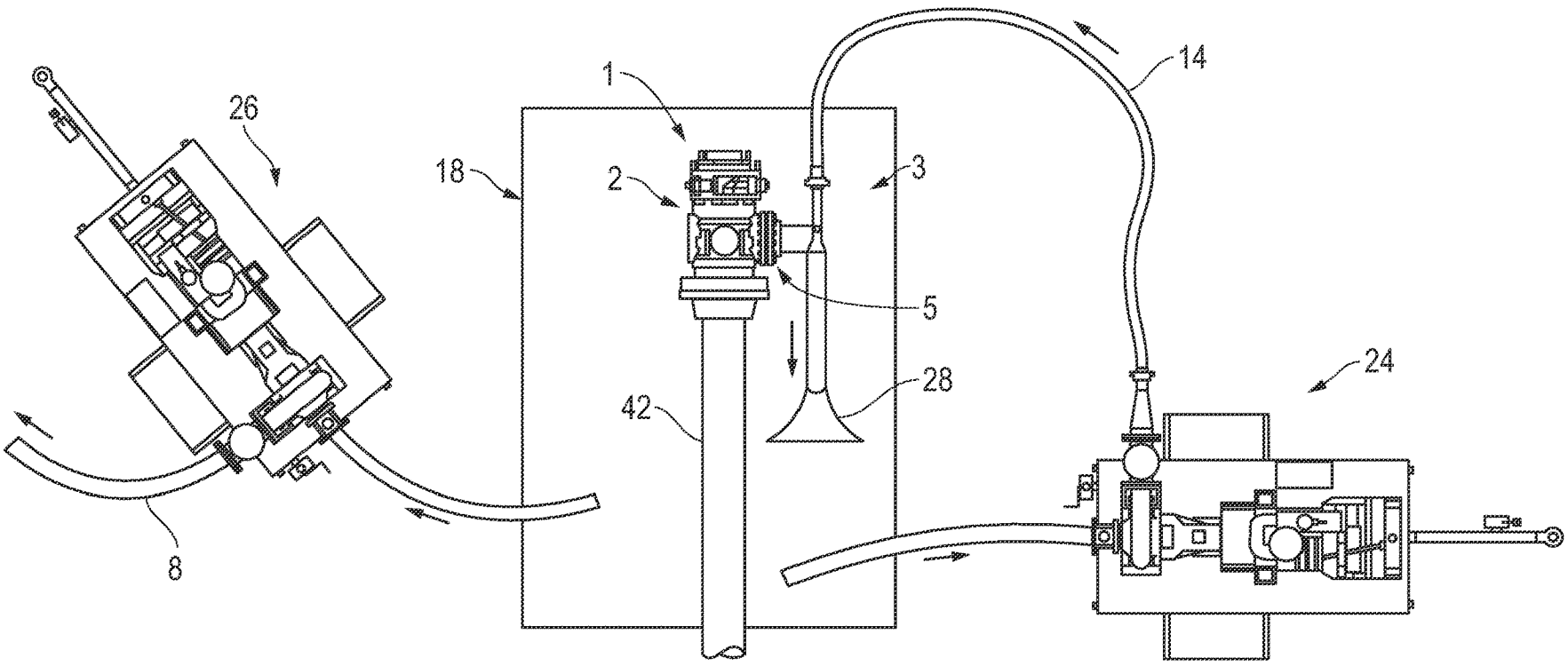
FIG. 2 depicts a top view of an exemplary embodiment of a mud recovery system using a rotating blowout preventer and Venturi device.

Referring to FIG. 2, a top view of an exemplary embodiment of a mud recovery system or apparatus 10 using a RBOP 2 and Venturi device 3 is shown. The mud recovery system or apparatus 10 comprises and/or contains, but is not limited to, an apparatus for working an underground arcuate path or horizontal directional drilling path 40 (shown in FIG. 3) around at least a portion of an obstacle 51, such as, by way of example only, a body of water, highway, railroad track, etc. (shown in FIG. 3) comprising a casing 42 extending into at least a lead portion 41 of the underground arcuate path 40 (shown in FIG. 3), a rotating control device 1, such as an RBOP 2, connected to the casing 42, and a venturi device 3 connected to said rotating control device 1. The figure shows the venturi mud line pump 24 connected to the venturi mudline or venturi flow line 14. The trash pump or dirty mud line pump 26 pumps mud from the pit or entry pit 18 through the dirty mud line 8. The trash pump or dirty mud line pump 26, the venturi mud line pump 24, and the mud pump or drill pump 22 (shown in FIG. 1) can be commercially available from a suitable supplier and may be separate or combined. A diffuser (28), such as a steel diffuser, may be connected to the venturi device 3. The Venturi device 3 may be connected to a lateral port 5 for said rotating control device 1 at a position external to the drill pipe.

Using FIGS. 1 and/or 2 as a reference, but not limited to the exemplary embodiments depicted in FIGS. 1 and/or 2, the following describes a method for working an underground arcuate path 40 around an obstacle 51 (shown in FIG. 3), comprising the steps of: lowering an annular pressure within a space encircling a drill pipe; wherein said step of lowering the annular pressure within the space encircling the drill pipe is performed by sucking a volume of drilling fluid out of the space encircling the drill pipe.

Using FIGS. 1 and/or 2 as a reference, but not limited to the exemplary embodiments depicted in FIGS. 1 and/or 2, the figures depict an apparatus for working an underground arcuate path 40 (shown in FIG. 3) around at least a portion of an obstacle 51 (shown in FIG. 3) comprising a casing 42 extending into at least a lead portion 41 of the underground arcuate path 40 (shown in FIG. 3), a rotating control device 1, such as an RBOP 2, connected to the casing 42, and a Venturi device 3 connected to said rotating control device 1.

Figure 3:
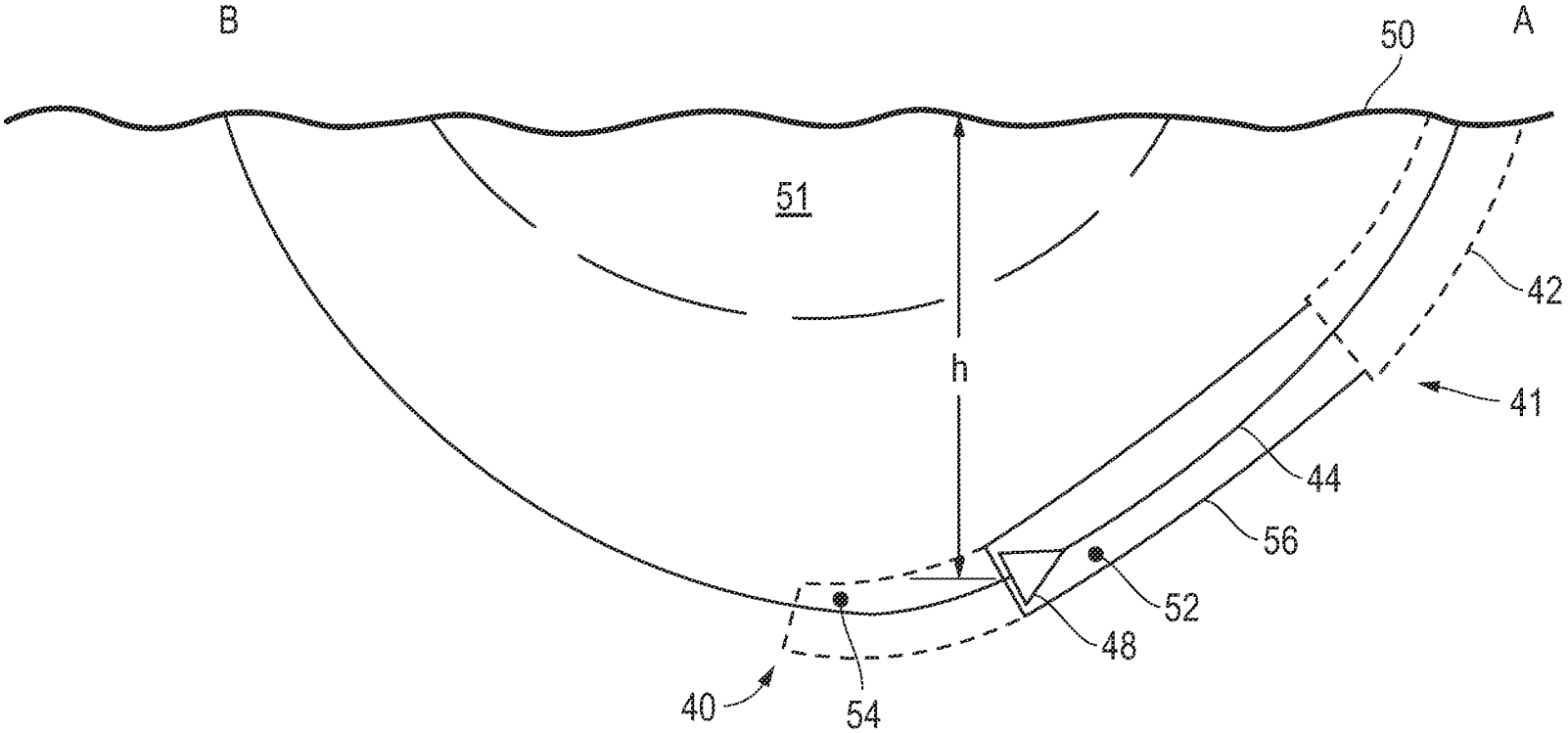
FIG. 3 depicts a schematic elevation view of an exemplary embodiment horizontal directional drilling path or underground arcuate path.

Referring to FIG. 3, a schematic elevation view of an exemplary embodiment horizontal directional drilling path or underground arcuate path 40 is shown. There is an entrance or entry A of the arcuate path 40 and a planned exit point B along the ground or rock formation 50, and which the arcuate path 40 may be worked around at least a portion of an obstacle 51. The schematic shows a casing 42 with the drill pipe 44 connected to downhole tooling or drill bit 48 located a height h from the surface of the ground or rock formation 50 as the drill bit 48 creates a bore 56. The pressure, P1, at point 52, also known as the space encircling 52 the drill pipe 44, of the bore, is lower as compared to the pressure, P2, at point 54, also known as the space encircling 54 the drill pipe 44, when the drill bit 48 has progressed to a deeper height further down the path 40. The system and/or apparatus and/or method for working an underground arcuate path around at least a portion of an obstacle as disclosed allows for a lower P1 and P2, which eliminates or mitigates chances of a frac-outs by reducing the annular pressure such that the pressure the soil or ground or rock formation or earth 50 can withstand is not exceeded.

While the embodiments are described with reference to various implementations and exploitations, it will be understood that these embodiments are illustrative and that the scope of the inventive subject matter is not limited to them. Many variations, modifications, additions and improvements are possible.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

The invention claimed is:

1. An apparatus for working an underground arcuate path around at least a portion of an obstacle, comprising:

a casing extending into at least a lead portion of the underground arcuate path;

a rotating control device connected to the casing;

a Venturi device connected to said rotating control device;

a drill pipe surrounded by the casing and said rotating control device for at least a portion of an axial length of the drill pipe;

a drilling rig connected to the drill pipe;

a mud flow line connected to the drilling rig;

a drill pump connected to the mud flow line;

a Venturi flow line connected to said Venturi device;

a pump connected to the Venturi flow line;

an entry pit formed proximate the casing and said rotating control device;

a trash pump connected to the entry pit;

a dirty mud line connected to the trash pump;

a mud cleaning unit connected to the dirty mud line;

a clean mud line connected to the mud cleaning unit; and a pumping unit connected to the clean mud line and to at least one of the drill pump and the pump connected to the Venturi flow line.

* * * * *